US005441403A

United States Patent [19]

Tanaka et al.

[11] Patent Number: 5,441,403

[45] Date of Patent: Aug. 15, 1995

[54] METHOD OF LOW-NOX COMBUSTION AND BURNER DEVICE FOR EFFECTING SAME

[75] Inventors: Ryoichi Tanaka; Mamoru Matsuo; Hitoshi Yahara; Jun Sudo, all of Yokohama, Japan

[73] Assignee: Nippon Furnace Kogyo Kaisha, Ltd., Kanagawa, Japan

[21] Appl. No.: 372,551

[22] Filed: Jan. 13, 1995

Related U.S. Application Data

[62] Division of Ser. No. 69,590, Jun. 1, 1993, Pat. No. 5,403,181.

[30] Foreign Application Priority Data

Jun. 5, 1992 [JP] Japan ..... 4-169894

[51] Int. Cl.[6] ..... F23C 5/28

[52] U.S. Cl. ..... 431/175; 431/177; 431/173; 431/284

[58] Field of Search ..... 431/8, 9, 173, 175, 431/177, 284, 285

[56] References Cited

U.S. PATENT DOCUMENTS

| | | | |
|---|---|---|---|
| 2,222,822 | 11/1940 | Nordensson | 431/285 |
| 2,822,864 | 2/1958 | Black | 431/284 |
| 4,395,223 | 7/1983 | Okigami et al. . | |
| 4,416,620 | 11/1983 | Morck . | |
| 5,073,105 | 12/1991 | Martin et al. . | |
| 5,195,884 | 3/1993 | Schwartz et al. | 431/8 |
| 5,271,729 | 12/1993 | Gensler et al. | 431/177 |
| 5,275,554 | 1/1994 | Faulkner | 431/9 |
| 5,284,438 | 2/1994 | McGill et al. | 431/9 |

FOREIGN PATENT DOCUMENTS

| | | |
|---|---|---|
| 76036 | 4/1983 | European Pat. Off. . |
| 1179016 | of 1984 | U.S.S.R. . |

OTHER PUBLICATIONS

Preceedings From First Conference/Lisbon P.T. Mar., 1988.

*Primary Examiner*—Carroll B. Dority
*Attorney, Agent, or Firm*—Notaro & Michalos

[57] ABSTRACT

A method of low-NOx combustion and a burner device for effecting the same, in which a primary fuel is injected in a direction from tile periphery of stream of a combustion air towards that same combustion air, effecting a first combustion, so as to create a generally cylindrical primary flame covering the combustion air, whereby a secondary fuel injected towards the combustion air is shielded or intercepted by such primary flame from the combustion air, while causing NOx in tile primary flame to be reduced by the secondary fuel, after which, a second combustion is effected by bringing the secondary fuel to contact with a portion of the combustion air penetrating through the primary flame, at a downstream side. This arrangement permits more positive decrease of NOx density in an exhaust gas.

13 Claims, 6 Drawing Sheets

METHOD OF LOW-NOX COMBUSTION AND BURNER DEVICE FOR EFFECTING SAME

This application is a division of application Ser. No. 08/069,590, filed Jun. 1, 1993, now U.S. Pat. No. 5,403,181.

BACKGROUND OF INVENTION

1. Field of the Invention

The present invention relates to a method of low-NOx combustion and a burner device for effecting the same. More particularly, the invention is directed to an improvement of a two-staged low-NOx combustion method and a two stage firing burner device for carrying out tile method.

2. Description of Prior Art

Among various conventional low-NOx combustion methods, there has been known a two-staged method comprising two fuel supply stages for doing the combustion at two stages, as disclosed, for instance, from tile Japanese Patent No. 1104160. (Hereinafter, tills method will be referred to as "two-stage fuel combustion method".) Such two-stage fuel combustion method is normally executed by a burner device as shown in FIG. 1. According thereto, there is provided a burner device BD' which has a burner throat 103 formed therein and one piece of primary fuel nozzle 101 disposed within the burner throat 103. Further, a plurality of secondary fuel nozzles 102 are provided around the outside opening of tile burner throat 103. Each of those secondary fuel nozzles 102 is oriented toward a primary flame which is to be flowed out from the burner throat 103. With this device, a whole amount of combustion air (as designated by "Air" in FIG. 1) is supplied in the throat 103, and a primary fuel is injected from the primary fuel nozzle 101 toward the combustion air, such that the primary fuel is embraced or circumscribed by the air, to thereby effect a combustion and create the primary flame. Then, in the vicinity of the opening of burner throat 103, a secondary fuel is injected from the secondary fuel nozzles 102 toward the thus-created primary flame, creating thus a secondary flame. Namely, in tills sort of combustion method, the first combustion stage uses the whole amount of combustion air to burn the primary fuel under a proper excess air condition set by an suitable excess air ratio (i.e. the so-called "air rich" condition), and then, the secondary fuel is injected to such first combustion, reducing a part of NOx existing in the primary flame and thereafter bringing the primary fuel in contact with the downstream portion of combustion air which remains not burned through the primary flame, so as to effect a second combustion, creating a secondary flame.

However, the above-described conventional method and burner device inject out the combustion air from the burner throat 103, in such a way that the primary flame is surrounded by the air, which has been found defective in that the combustion air, which flows in tile thin-arrow direction in FIG. 1, results in expanding its stream at tile exit of burner throat 103 as indicated by the arrow As, and the expanded portion of air directly contacts the secondary fuel injected from the secondary fuel nozzles 102, causing a combustion in this particular area. Hence, a part of tile secondary fuel is directly contacted with such leaked air (As) before contact with the primary flame, starting thus a secondary combustion in advance. Consequently, tile combustion air is not fully used to reduce the NOx in the primary flame and there is a problem of insufficient NOx reduction. Although this prior-art technique serves the low NOx purpose based on the thick and thin fuel combustion principle, more effectively than most of ordinary combustion techniques, yet there is a room of improvement for the reason above.

SUMMARY OF THE INVENTION

In view of the above-stated drawbacks, it is therefore a primary purpose of the present invention to provide a method of low-NOx combustion which enables more positive decrease of NOx density.

In order to achieve such purpose, in accordance with the present invention, there is basically provided the steps of:

injecting a substantially whole amount of combustion air through a burner throat;

then, at a first fuel supply stage, injecting a primary fuel from the periphery of stream of tile combustion air towards tile same combustion air, thereby subjecting tile primary fuel to a first combustion so as to create a generally cylindrical shape of primary flame covering the stream of combustion air; and at a second fuel supply stage, injecting a secondary fuel towards tile thus-created primary flame from outside thereof, and further subjecting tills secondary fuel to a second combustion with a portion of tile combustion air which penetrates through the primary air at a downstream side so as to create a secondary flame, whereby the combustion air is initially covered with the primary flame before a point where the secondary fuel is injected, so that tile secondary fuel, immediately after being injected towards said combustion air, is shielded or intercepted by said primary flame from said combustion air, thus causing contact of said secondary fuel with said primary flame to reduce NOx, and thereafter, the second combustion is carried out.

It is a second purpose of the present invention to provide an improved burner device for effecting the above-mentioned low-NOx combustion method.

To attain this purpose, in accordance with the present invention, there is basically provided a burner device for the low-NOx combustion which comprises:

a burner throat means through which a substantially whole amount of combustion air is injected;

a first injection means for injecting a primary fuel towards said combustion air, which first injection means is provided in the burner throat means and having an injection axis oriented towards a central axis of the burner throat;

a secondary injection means for injecting a secondary fuel in a direction towards the primary fuel from outside thereof.

In both of the foregoing method and burner device, it is preferable that the injection axis of the first injection means is oriented at an angle in a direction towards a downstream with respect to tile combustion air in order to inject the primary fuel to the combustion air in such direction.

In one aspect of the invention, the injection axis of the first injection means may be oriented in a direction tangential to the inner surface of the burner throat means, to thereby inject the primary fuel to the combustion air it that tangential direction so as to create a generally cylindrical primary flame in a vortex manner.

In another aspect of the invention, the burner throat manes may be of a generally cylindrical shape and the first injection means may comprise a plurality of nozzles disposed along such cylindrical shape of burner throat means, so that the primary fuel is injected in a direction from the circumference of circle towards the combustion air, thereby creating a generally circular cylindrical shape of primary flame.

In still another aspect of the invention, the burner throat means may be of a rectangular cylindrical shape and the first injection means may comprise a plurality of nozzles along such rectangular cylindrical shape of burner throat means, so that the primary fuel is injected in a direction from the rectangular line towards the combustion air, thereby creating a flat configuration of primary flame having a generally rectangular cross-section.

Preferably, two or more first injection means may be provided equidistantly in the inner surface of the burner throat means, and also two or more second injection means be provided adjacent to the exit of the burner throat means.

Preferably, the burner throat means may a burner tile throat disposed at at downstream side with respect to the combustion air, and inner throat member disposed at an upstream side with respect to the same air, the inner throat member extending towards the inside of burner the throat in registry with an inner surface of the same burner tile throat, and further tile first injection means may be provided between those burner tile throat and inner throat member. In this case, more preferably, the second injection means may be provided adjacent the exit of burner tile throat such as to be oriented towards tile central axis of those burner throat elements.

In addition, a baffle plate may preferably be provide adjacent to the injection holes of the first injection means and further disposed at an upstream side relative to the combustion air.

It is also preferable that an air velocity adjustment means be provided within the burner throat means such as to be disposed coaxially relative to tile central axis of burner throat means, whereby a velocity distribution of the combustion air injected through the burner throat means may be adjusted properly in order to insure a better formation of the cylindrical primary flame.

Accordingly, tile formation of generally cylindrical primary flame serves to cover or encircle the combustion air, earlier than the injection of the secondary fuel to the air, to thereby shield the air form tile secondary fuel while at the same time, the NOx in the primary flame is reduced by the secondary fuel. Thereafter, a second combustion is effected by bringing the secondary fuel to contact with the portion of combustion air at the downstream side. With this arrangement, it is possible to decrease the NOx density in the exhaust gas emitted, in a more positive way.

DETAILED DESCRIPTION OF PREFERRED EMBODIMENTS OF THE INVENTION

Now, a specific description will be made of the processes and constructions of a low-NOx combustion in accordance with the present invention, with reference to FIGS. 2 through 12.

Figure 1:
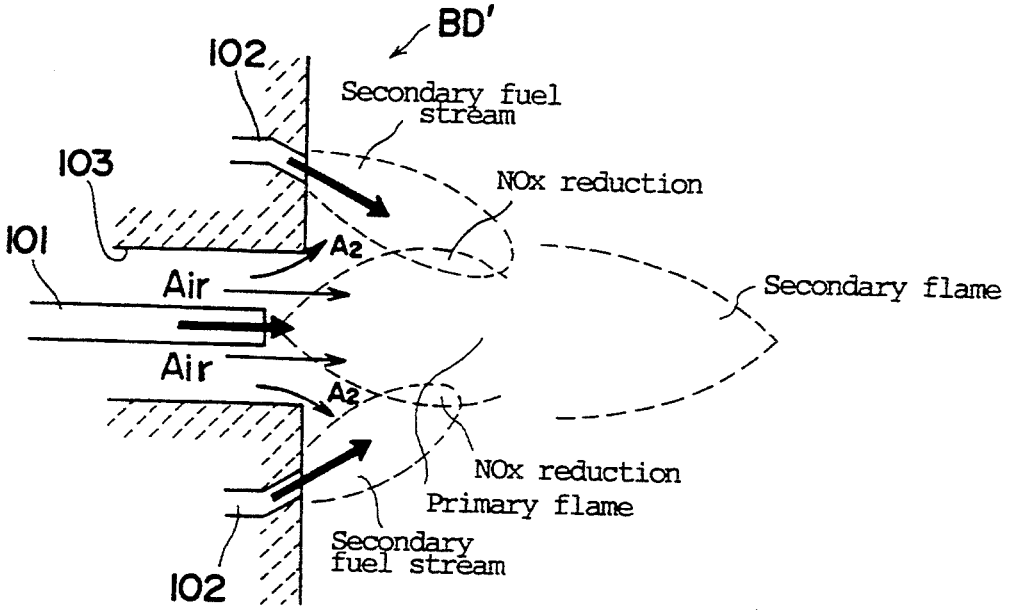
Fig. 1 PRIOR ART
FIG. 1 is a schematic diagram showing a low-NOx combustion manner of a conventional burner.
Figure 2:
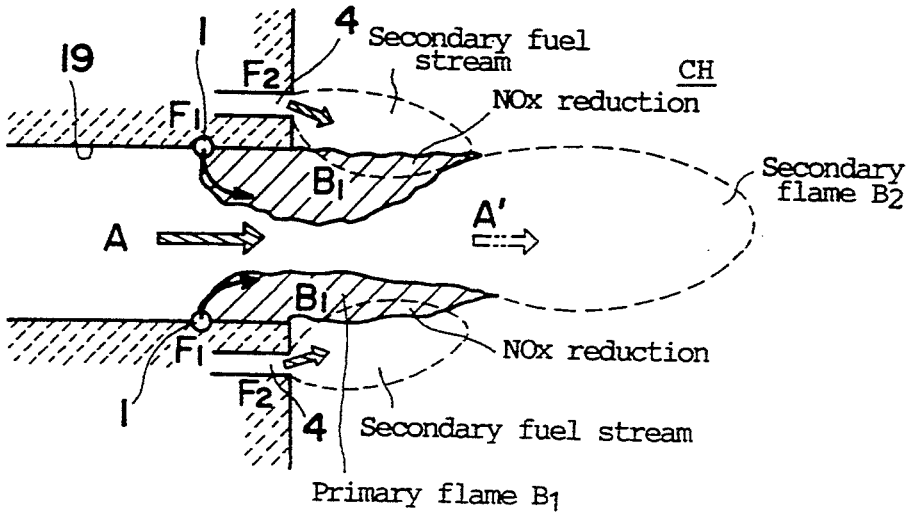
FIG. 2 is a schematic diagram showing a low-NOx combustion manner by one embodiment of burner in accordance with the present invention.

FIG. 2 schematically shows a principle of low-NOx combustion in the present invention. Basically, this is similar to the previously described prior-art two-stage fuel combustion method in terms of the first and second fuel supply stages involving injection of primary fuel to the combustion air and subsequent injection of secondary fuel to the downstream portion of the air. According to the invention, as shown in FIG. 2, a substantially whole amount of combustion air A is supplied and subject to a first combustion by a primary fuel F1 being injected thereto, and then, the downstream portion of the same air A .(adjacent to the inside of combustion chamber CH) is subject to a second combustion by injection of a secondary fuel F2 thereto.

It should be noted that the definition of "a substantially whole amount of combustion air A" as above is intended to entail the case where a part of the air A may be utilized as a cooling air for cooling tile secondary nozzles 4. But, in tile actual combustion process, it can be regarded as a whole amount of combustion air A to which the primary fuel F1 is injected.

In this context, the ratio of distribution between the primary and secondary fuels F1, F2 with respect to the combustion air A may be set at any proper degree, which is not limitative, but for example, may be set by a proper ratio out of 90–30% by volume of secondary fuel F2 against 10–70% by volume of primary fuel F1.

Designations 1, 4 and 19 denote a primary fuel nozzle for injecting the primary fuel F1, a secondary fuel nozzle or injecting the secondary fuel F2 and a burner throat, respectively.

As understandable from FIG. 2, the low-NOx combustion method in the present invention essentially includes a first stage where the primary fuel F1 is injected in a direction from tile periphery of stream of the combustion air A flowing in the burner throat 19, towards tile air A per se, and ignited by a pilot burner (not shown) or the like to start a combustion and create a generally cylindrical shape of primary flame B, confirming generally to the inner surfaces of burner throat 19, so that tile primary flame B1 surrounds or circumscribes the combustion air A. For that purpose, at least two or more primary fuel nozzles 1 should be provided in order to produce such cylindrical primary flame B1 and preferably those plural nozzles 1 be disposed equidistantly along the inner surfaces of or circumferentially of the burner throat 19. At this point, a part of the combustion air A is subject to this particular first combustion, creating the cylindrical primary flame B1 immediately from the exit of burner throat 19 and a remainder of tile air A passes through within the cylindrical primary flame B1 to the downstream side (see the designation A' in FIG. 2). Then, the secondary fuel F2 is injected toward that primary flame B, from the secondary fuel nozzles 4 which are disposed outside the primary flame B1. At this moment, it is seen from FIG. 2 that, since the combustion air A is initially covered with the primary flame B1 from the exit of burner throat 19, time secondary fuel F2, immediately after its injection towards the air, is inevitably contacted with the primary flame B1 and thus intercepted or shielded by tile same flame B1 per se from the stream of air A passing centrally therewithin.

Under this state, it is also seen that the primary flame B1 is placed in the condition containing an excessively small amount of residual oxygen therein, and the secondary fuel F2 applied to such primary flame B1 causes a high efficient reduction of NOx in the primary flame B1 at the area contacting therewith as shown in FIG. 2, which will also be explained later.

Next, at the downstream side away from the primary flame B1, the secondary fuel F2 is contacted with the remaining combustion air A' penetrating through that primary flame B1, to thereby perform a second combustion. At this second combustion stage, a secondary flame as designated by B2 is created at the side of combustion chamber CH.

It is therefore appreciated that the combustion air A injection from the burner throat 19 is shielded on the peripheral region by the primary flame B, from the secondary so as to insure that the NOx in the primary flame B1 is reduced by the secondary fuel F2, and thereafter the air is fully burned by the same secondary fuel F2.

Referring now to FIGS. 3 through 6, there is illustrated a first embodiment of burner device for effecting the above-described low-NOx combustion method.

In the present embodiment, there is presented a cylindrical burner device BD1 having a cylindrical burner casing 15. Arranged in the burner casing 15, are a burner tile 17, a burner tile throat 19 and an inner throat member 8. Both burner tile throat 19 and inner throat member 8 form a burner throat in this particular device BD1, which also refers to the throat 19 schematically in the aforementioned method. The burner tile throat 19 is formed cylindrically in the center of the burner tile 17, facing towards the combustion chamber CH. The inner throat member 8 has cylindrical wall extending in registry with the inner surface of the burner tile throat 19 in a direction inwardly of the casing 15.

Figure 4:
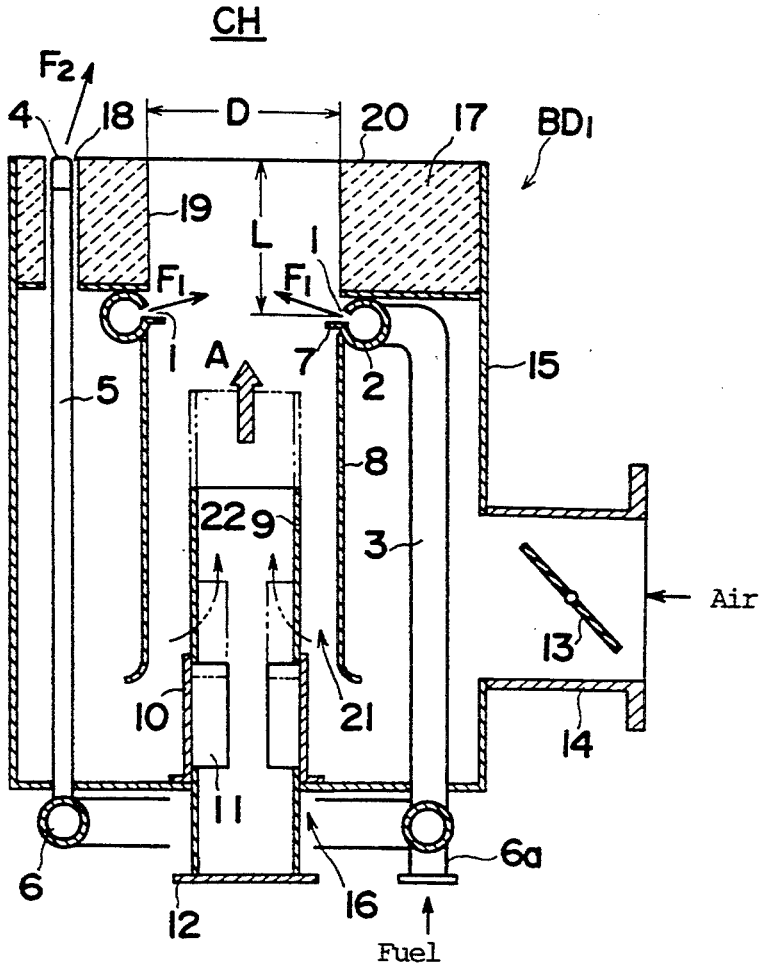
FIG. 4 is a longitudinally sectional view taken along the line IV–IV in FIG. 3.

As shown in FIG. 4, an annular header 2 is arranged between the above-stated burner tile throat 19 and inner throat member 8 in a manner surrounding the circumference of those two elements. The primary fuel nozzles 1 are connected to this annular header 2, as will be explained later.

Figure 6:
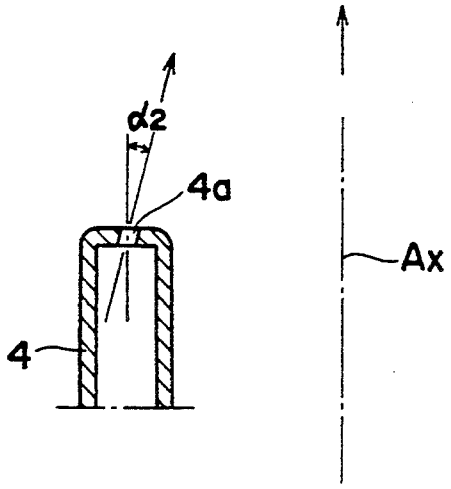
FIG. 6 is an enlarged sectional view of a secondary fuel nozzle.

More than one or preferably more plural secondary nozzles 4 are disposed via lance pipe holes 18 outwardly of the burner tile throat 19. In the embodiment shown, four secondary nozzles 4 are arranged in the burner tile 17 such that they are disposed equidistantly along the circumference of a circle in a coaxial manner relative to the central axis of burner tile throat 19. The number of such secondary fuel nozzles 4 is not limited thereto, but the experiments show that such equidistant disposition of 4 to 6 secondary fuel nozzles is most effective in reducing NOx in tile primary flame B1. The secondary fuel nozzles 4 may be disposed at the burner tile front 20 or in tile neighborhood thereof, for instance, and adopted to inject a predetermined amount of the secondary fuel F2 toward the inside of combustion chamber CH. As shown in FIG. 6, each of the secondary fuel nozzles 4 has an injection hole **4*a* which is oriented at a given angle toward a central axis of the burner throat (19, 8) so that the secondary fuel F2 is injected at an angle $\alpha 2$ toward the primary flame B1**. Preferably, such injection angle $\alpha 2$ may be set from the range between 0 to 60 degrees, but this is not necessarily limitative.

Although not clearly shown, those secondary fuel nozzles 4 are normally connected to a fuel supply header 6 located outside the casing 15, via their respective fuel supply pipes or the so-called lance pipes 5. The fuel supply header 6, as shown in FIG. 4, is formed in an annular shape, having a connecting pipe portion **6*a* provided therein. This annular header 6 is communicated with the four lance pipes 5 as understandable from FIGS. 3 and 4 and further communicated with the upper annular header 2 via a pipe 3. The connecting pipe portion 6*a*, though not shown, is connected to an external fuel supply system. Thus, a full amount of fuel supplied from such supply system is introduced through the connecting pipe portion 6*a* into each of tile upper and lower headers 2, 6 as can be seen in FIG. 4, whereby tile fuel is distributed into each of the primary and secondary fuel nozzles 1, 4**.

It is noted that the foregoing lance pipe hole 18, through which each lance pipe 5 extends, may be so formed to have an inner diameter slightly greater than the outer diameter of the lance pipe 5, providing thus a slight clearance between the lance pipe 5 and the inner surface of hole 18 in order to allow a part (a few percent) of the combustion air A to pass through that clearance, thereby cooling each secondary fuel nozzle 4.

Figure 3:
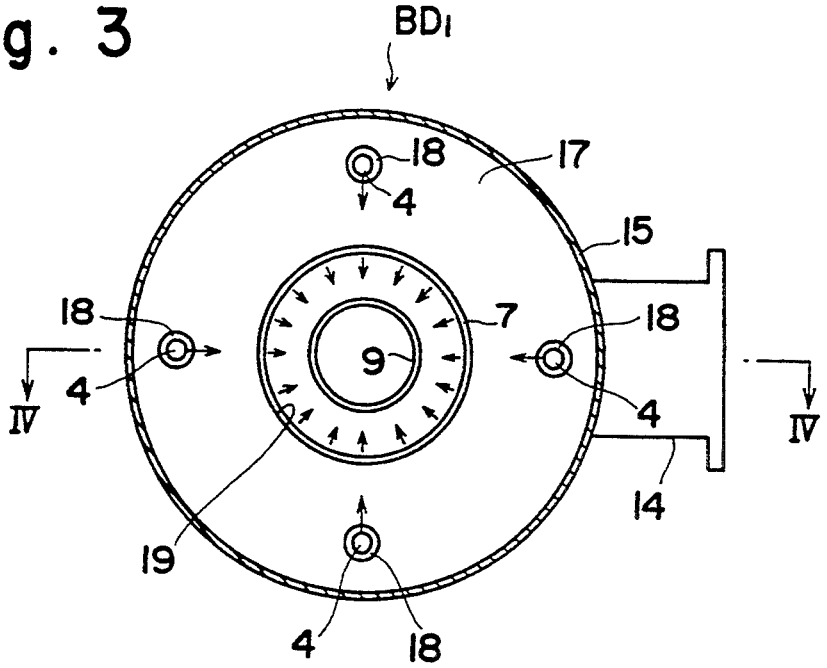
FIG. 3 is a front view of a first embodiment of the low-NOx burner in accordance with tile invention.

As shown in FIG. 3, an air supply connecting pipe 14 is formed on the lateral wall of tile burner casing 15. This pipe 14 has, provided therein, a rotary air damper member 13 which is rotatable to permit adjusting the opening degree of the pipe 14. In other words, the pipe 14 works as an air damper device. Though not shown, an external air supply system is connected to such connecting pipe 14, allowing supply of the combustion air into the burner casing 15. The amount of combustion air to be supplied into the casing 15 may be adjusted by operation of the rotary air damper member 13.

Figure 5:
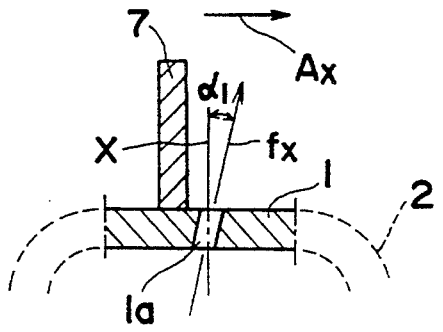
FIG. 5 is an enlarged sectional view of a primary fuel nozzle.

The primary fuel nozzles 1, in this embodiment, are located between the burner tile throat 19 and inner throat member 8, the arrangement thereof being such that the nozzles 1 are disposed along the circumference of a circle generally equal in diameter to the diameter of those two throat elements 19, 8 and that each of the same nozzles 1 is oriented such as to inject the primary fuel F1 in the direction from the periphery of the stream of combustion air A flowing in the burner throat (19, 8) towards that particular combustion air A. In other words, the primary fuel F1 is injected in the direction from the circumference of circle towards the combustion air A, to thereby create a generally circular cylindrical primary flame B, having a generally annular cross-section. The illustrated primary fuel nozzles 1 are each formed with an injection hole 1*a*. The injection holes 1*a* are formed equidistantly in the inward surface of the annular header 2 and opened inwardly thereof, as understandable from FIG. 4 at the designation 1. The formation of each injection hole 1*a* is generally shown in FIG. 5. Namely, tile injection hole 1 of primary fuel nozzle 1 is oriented at a given injection angle a, relative to the axis X orthogonal with the axis Ax of combustion air flow, directing its injection axis fx towards the downstream portion of the combustion air A or in a direction to intersect the combustion air flow axis Ax. With this arrangement, the primary fuel F, will be injected at that injection angle $\alpha 1$ toward the primary flame B1 at the downstream side. For instance, the injection angle $\alpha 1$ may preferably be set from tile range within 0 to 60 degrees. Of course, this angle is not limited thereto.

With regard to the number of the injection holes 1*a*, the inventors conducted experiments and found that more than eight injection holes 1*a* are most effective in setting the primary fuel injection points enough to create a complete cylindrical primary flame B, which completely circumscribes tile combustion air A as seen in FIG. 2. Needless to mention, the injection holes la may be formed in any number insofar as they achieve such complete cylindrical primary flame.

A baffle plate 7 of a ring-like plate configuration is integrally formed on and along tile inward peripheral surface of the header 2 such as to be located adjacent the foregoing injection holes 1*a* of primary fuel nozzles 1. As best seen from FIG. 4, the baffle plate 7 is situated at the downstream side within the burner throat, projecting a small distance inwardly thereof so as to provide a proper efficiency for protecting the primary flame B1 from direct blow of combustion air A at tile injection holes 1*a*. Otherwise stated, the plate 7 serves to prevent a direct flow of tile air A into the area in the proximity of the injection holes 1*a*, thereby holding stable the root portion of the primary flame B1.

Reference is made to FIG. 4. The present invention further contemplates a ratio of the diameter D of burner tile throat 19 against the distance L between the primary fuel nozzle injection holes 1*a* and burner tile front 20 in order to set an optimal position of tile primary fuel nozzles 1 that insures expanding the primary flame F1 to a sufficient degree within the burner tile throat 19 and forming the intended complete cylindrical shape of primary flame F1. In this instance, such L/D ratio should be more than 0.5, but it may be set properly, depending on the structural dimensions of the burner device to be used and the like.

As shown in FIG. 4, an air velocity adjustment device 16 is provided inwardly of the inner throat member 8 and at the upstream side from the above-described primary fuel nozzles 1. The air velocity adjustment device 16 extends along the central axis of burner casing 15 or the axis of burner throat in the present burner device BD1, comprising a cylindrical shutter member 10 fixed on the inner surface of bottom wall of burner casing 15, and a tubular movable member 9 slidably fitted in the shutter member 10, the tubular movable member 9 penetrating through the bottom wall of burner casing 15 and being movable vertically along tile burner throat axis. Such movable member 9 has, perforated in its peripheral surface, a pair of spaced-apart air inlet holes 11. As shown by the solid line in FIG. 4, the air inlet holes 11 are completely closed by the shutter member 10, but to push and move the movable member 9 upwardly as indicated by the two-dot chain line will open the air inlet holes 11 to allow a part of the combustion air A to flow through the holes 11 into the movable member 9, thereby flowing the air upwardly in the arrow direction towards the exit of burner tile throat 19. Namely, the air, after passing through the inlet holes 11, is directed towards the center of burner throat, then injected in that direction along the axis of burner throat (8, 19), and jetted out towards the combustion chamber CH. In practice, an operator depresses and draws the movable member 9 in the longitudinal direction along the burner throat axis so as to adjust the opening degree of the air inlet holes 11 relative to the shutter member 10. In this way, it is readily possible to adjust the amount of air (designated at 22) into the movable member 9 and jet out the air at a proper velocity. A flange 12 is formed at the free end of the movable member 9 which projects from the bottom of burner casing 15, the flange 12 facilitating the ease with which an operator grasps the movable member 9 more positively to assure its movement.

As seen in FIG. 4, the cylindrical wall of the inner throat member 8 extends in the direction toward the upstream side away from the level at which the primary fuel nozzles 1 lie at the downstream side, with respect to the stream of combustion air or the burner throat axis, and terminates at a point spacing apart from the bottom wall of burner casing 15. This construction defines a main air inlet passage for allowing a substantially whole amount of the combustion air supplied from the connecting pipe 14 to smoothly flow into the upstream-side opening of inner throat member 8. The thus-introduced air is partly flowed into the above-stated movable member 9 of air adjustment device 16 through the two air inlet holes 11 thereof as indicated at 22, whereas other part of the air is flowed outside the movable member 9 as indicated by a designation 21.

It is thus understood that in the air velocity adjustment device 16, the combustion air is bifurcated into the above-mentioned two air streams designated by 21 and 22. Namely, the former 21 flows through the annular spacing between the inner throat member 8 and movable member 9, and the latter 22 flows within the movable member 9 along the central axis of burner throat. Accordingly, as with usual velocity distribution found in a pipe, the central air stream 22 flows at a far greater velocity than the surrounding or peripheral air stream 21, whereupon it is possible by operation of the foregoing device 16 to adjust such velocity distribution so as to cause the central air stream 22 to penetrate through the primary flame B1 which is created mainly from the peripheral air stream 21.

Figure 7:
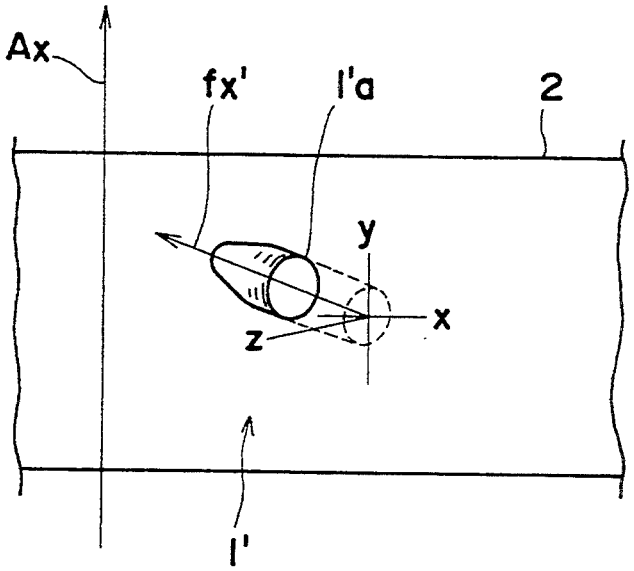
FIG. 7 is a partly broken perspective view showing another embodiment of the primary fuel nozzle.

FIG. 7 shown another mode of injection hole of the primary fuel nozzle 1. In this embodiment, there are formed another primary fuel nozzles designated by 1' in the inward circular surface of annual header 2, although they are shown to be in a singular form. Each of these nozzles 1', in addition to being formed in the same manner with the one 1, is provided with a differently formed injection hole 1'*a* which is oriented in the direction tangential to a circle along which there extend the inner circular surfaces of burner throat (8, 19). More specifically, referring to FIG. 7, the injection hole 1'*a* is formed such that it is not only oriented at an angle equal to the above-noted angle α1 in respect to the axis "z" orthogonal with the combustion air flow axis Ax, but also oriented at a certain angle in respect to the axis "x" which forms a tangent line touching the circle along which the inner circular surfaces of burner throat extend, so as to define a new primary fuel injection axis "fx'".

Figure 8:
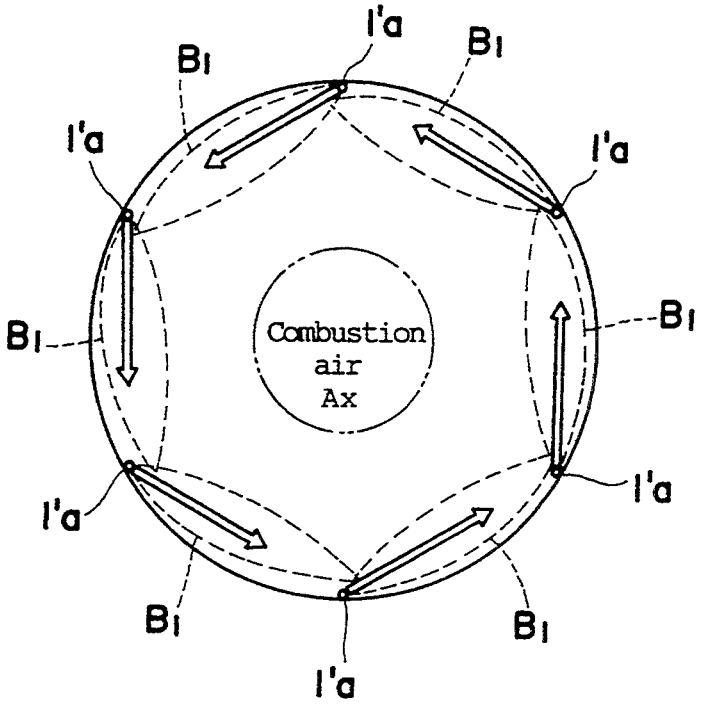
FIG. 8 is a schematic diagram which explanatorily shows a primary flame created by such another primary fuel nozzle as in FIG. 7.

In the present embodiment, experiments reveals that the primary flames B1 created from tile foregoing new injection holes 1'*a* are curled or assume a vortex-like flow in the above-said tangential direction and Jetted around the combustion air A with respect to the axis Ax thereof, as shown in FIG. 8. Further, the experiments teach that such vortex-like flow of air serves to expand tile primary flames B1 circumferentially of the combustion air flow, more widely than the aforementioned first mode of injection holes 1*a*, and this is found to cover a sufficient cylindrical range of primary flames even if tile associated primary fuel nozzles 1' are provided in a smaller number than eight. In other words, such curling effect of flames compensates for a less number of primary fuel nozzles 1' used than the ideal number of eight, and results in attaining the sufficient shielding effect that shields the central stream of combustion air by the primary flames B1 as explained above. For instance, from the results of experiments, at least more than two primary fuel nozzles 1' were found to suffice in achieving such flame vortex effect and air shielding effect. Hence, in terms of reduction of injection holes and the air shielding effect, this tangential orientation of second injection holes 1'*a* is more advantageous than the first injection holes la which are merely oriented in the direction along a normal relative to the tangential direction of the second ones 1'*a*.

Of course, the injection nozzles (1*a* or 1'*a*) may be increased on the contrary in an attempt to make smaller each of the primary flames B1 per nozzle while increasing the surface area of total flames, to thereby avoid the heat residing phenomenon within the flames B1. This is also naturally effective in lowering the generation of NOx. The same goes for tile secondary fuel nozzles 4.

With the burner device B1 constructed above, a description will be made of its combustion processes in more details as follows.

Firstly, a substantially whole amount of combustion air A is encircled or circumscribed by the primary fuel F1 injected from the primary fuel nozzles (1 or 1') and then Jetted out from the burner tile throat 19, creating the cylindrical shape of primary flame B1 which conforms to the inward circular surfaces of the burner tile throat 19. Theoretically stated in this regard, the primary fuel F1 being injected from the nozzles (1 or 1') is forcibly changed its flowing direction by the momentum of combustion air A intersecting it, within tile burner throat, and flowed in the downstream direction to the exit of burner tile throat 19. Then, tile primary fuel F1, upon coming out of the burner tile throat 19, is quickly burned with the peripheral portion of air A by a pilot burner (not shown) at the same time, creating thus a generally cylindrical shape of primary flame F, which conforms generally to the inner circular surface of burner throat 19.

It is noted here that if for example the fuel is distributed into the primary and secondary fuel nozzles 1, 4 at the ratio of 50/50, then the primary fuel F, injected from the primary nozzles 1 is burned under an excess air ratio twice as much as the theoretical amount of air normally required, because the substantially whole amount of combustion air A is flowed into the burner throat (8, 19) as stated above. Consequently, it is possible to suppress the generation of NOx down to a lowest possible level at a lower flame temperature in comparison with the hitherto ordinary diffusion flame method which shows such NOx characteristics in FIG. 11, which will be explained more specifically later with reference to FIG. 12.

Thus, taking the advantage of the foregoing remarkable excess air ratio and, if desired, increasing the primary and secondary fuel nozzles (1 or 1' and 4), may amplify the lowering of the flame temperature and contribute to minimize the amount of NOx to be generated in the flames.

Now, at this first combustion stage, the cylindrical primary flame B1 completely circumscribes the combustion air A, as in FIG. 2. Then, the secondary fuel F2 is injected from the secondary nozzles 4 towards the primary flame B1, but the cylindrical flame wall formed by that primary flame B1 has already been emitted outwardly from the point before the position of secondary fuel nozzles 4, thereby initially encircling the combustion air prior to tile next injection of secondary fuel F2 thereto and thus keeping the secondary fuel F2 away from contact with the central stream of combustion air penetrating through tile primary flame B1. For this reason, the secondary fuel F2, even though it may be injected towards the air immediately after the creation of primary flame B1, is inevitably contacted with the primary flame B1 and intercepted thereby from the stream of combustion air.

At that moment, such contact of tile secondary fuel F2 with the primary flame B1 brings about a combustion reaction on the outer peripheral surfaces of tile primary flame B1 to reduce NOx present therein. It is important to note that, as a result of the earlier first combustion stage mentioned above, the density of residual oxygen in the outer peripheral surfaces of primary flame B1, is extremely lowered, which generates an extremely-low-oxygen thin layer of combustion gas surrounding the primary flame B1, and immediately thereafter, the secondary fuel F2 is injected for direct contact with such extremely-low-oxygen thin layer of combustion gas, with the result that a rapid oxidation reaction is avoided and simultaneously the partial reduction of NOx is expedited.

Finally, the unburnt portion of the secondary fuel F2, not subject to combustion with the primary flame B1, is brought to contact with tile central stream of combustion air penetrating through the primary flame B1, at the downstream side away from that primary flame B1, and performing a second combustion for creating the secondary flame B2.

In this way, in accordance with the present invention, it is possible to minimize the NOx density in the exhaust gas discharged therefrom.

Figure 12:
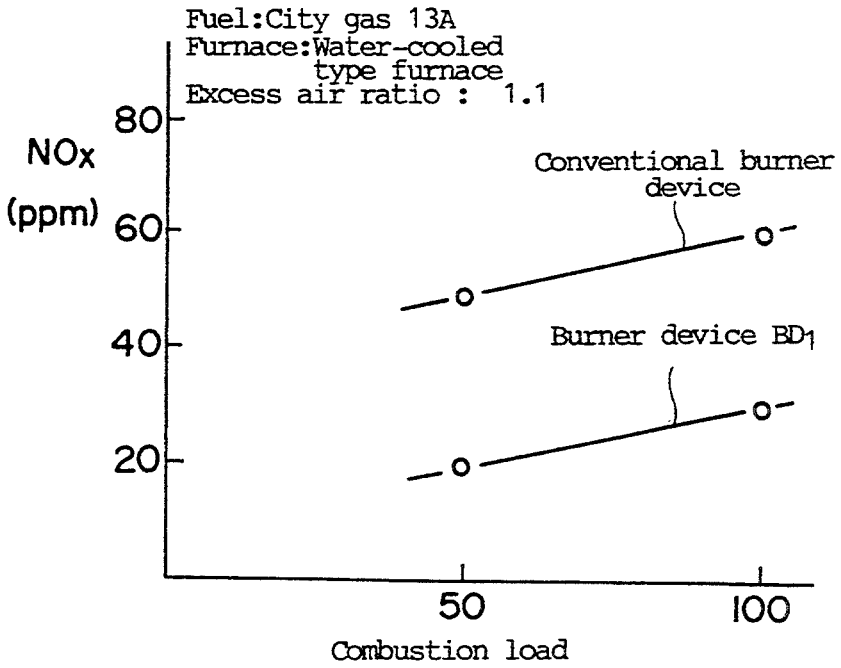
FIG. 12 is a graph which gives a comparative data on the amount of generated NOx between tile two-stage low-NOx burner of the present invention and conventional two-stage low-NOx burner.

FIG. 12 shows an example of data obtained from an actual experiment, using the above-constructed burner device BD1. The fuel used was a city gas (Class 13A under the Japanese gas classification). The two-stage firing burner device BD1 was mounted in a water-cooled type furnace, and the experiments were done under the excess air ratio of 1.1. The result is shown from the graph of FIG. 12. It is observed that the burner device BD1 lowers the NOx reduction at 50% in the exhaust gas as compared with the conventional two-stage firing burner device.

Figure 9:
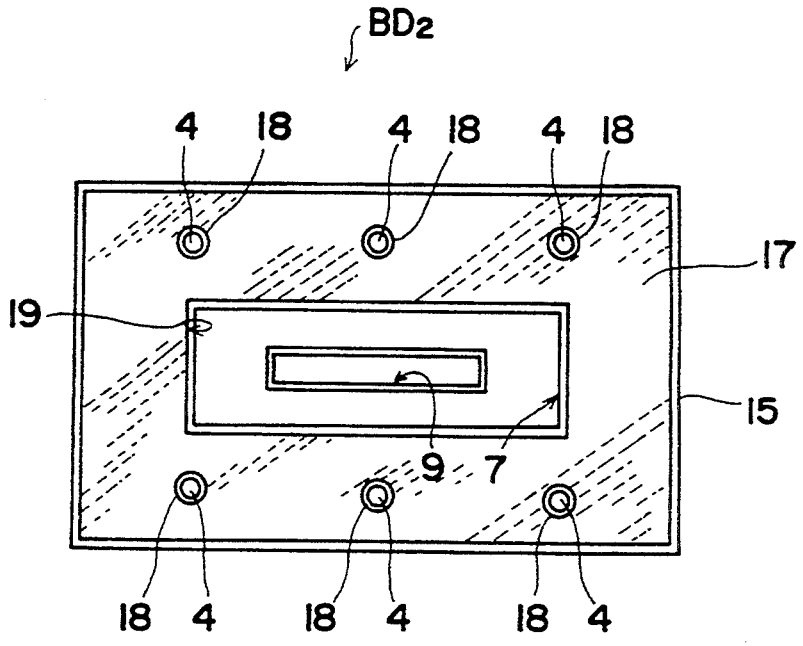
FIG. 9 is a front view of a second embodiment of the low-NOx burner in accordance with the invention.

Referring to FIG. 9, there is shown a second embodiment of burner device in accordance with the present invention, which presents a rectangular shaped burner device BD2. This device BD2 forms a flat flame having a generally rectangular cross-section, which surrounds the combustion air A in that flame configuration and realizes the same low-NOx combustion as the foregoing burner device BD1. In the present second embodiment, the burner housing 15 is formed in a rectangular shape, so that the burner tile 17, burner tile throat 19, inner throat member (not shown), and movable member 9 of air velocity adjustment device are all shaped in tile likewise rectangular form.

Figure 10:
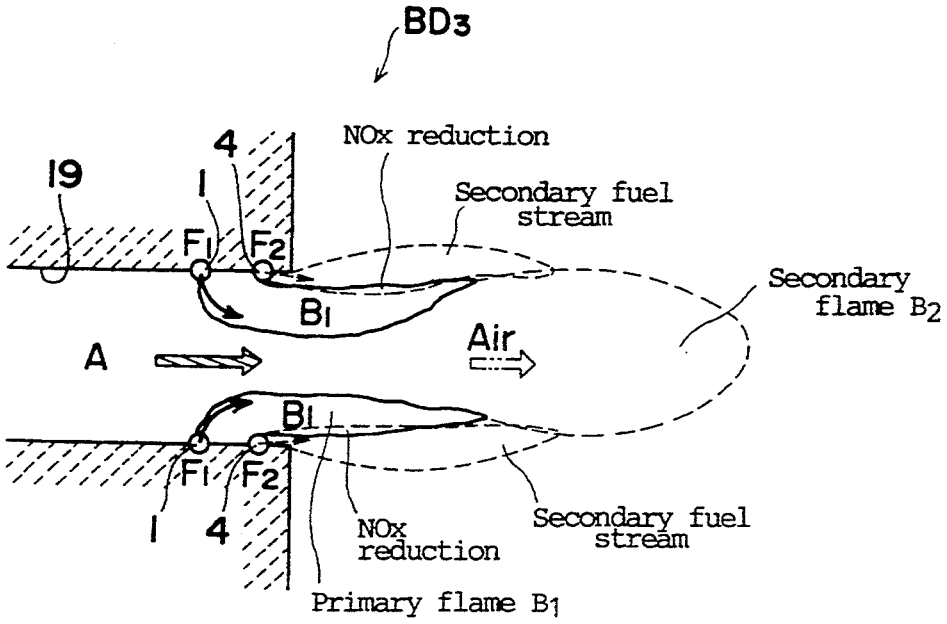
FIG. 10 is a schematic diagram showing a still another embodiment of the burner in the present invention.
Figure 11:
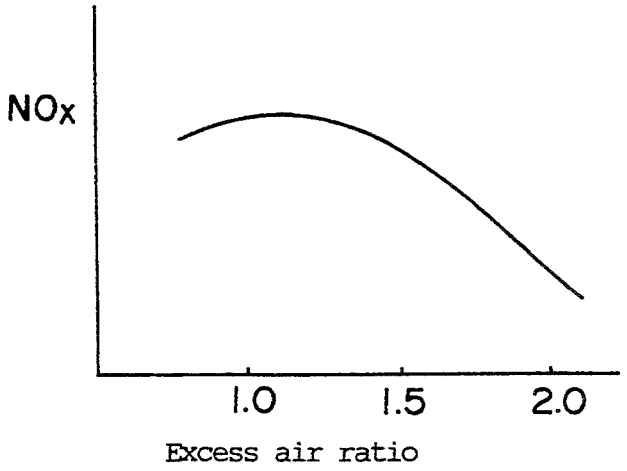
FIG. 11 is a graph showing a relation between an excess air ratio and an amount of generated NOx, which is normally found in an ordinary diffusion flame combustion method.

In addition, as shown in FIG. 10, there may be provided another burner device BD3 which differs only in the disposition of secondary fuel nozzles 4 from the above-described two burner devices BD1 and BD2. This embodiment suggests that the secondary fuel nozzles 4 be disposed on the inner surface of burner of burner tile throat 19. Of course, the secondary fuel nozzles 4 must be located adjacent to the exit of burner tile throat 19 or at a more downstream side than the primary fuel nozzles 1 in order to carry out the same combustion manner as in the foregoing burner device BD1 or BD2.

Furthermore, the burner device may be constructed as a multi-fuel combustion type by providing a pilot burner and/or oil burner gun in tile movable member 9 of air velocity adjustment device 16.

From the descriptions above, tile low-NOx combustion method and burner device therefore in accordance with the present invention produces the undermentioned advantageous features.

(i) At the first combustion stage, tile combustion air is embraced or encircled by the generally cylindrical primary flame, whereby the secondary fuel injected thereto is shielded or intercepted by that primary flame from tile combustion air. Hence, the secondary fuel is contacted with the primary flame to reduce NOx present therein, and then subject to a second combustion with tile portion of combustion air penetrating through the primary flame. In that manner, it is practically possible to insure the decrease of NOx density by virtue of the complete air shielding effect of tile primary fuel and the NOx reduction effect of the secondary fuel.

(ii) The primary fuel nozzle may be oriented in the direction tangential to the circle along which the inner surface of burner throat extends, to thereby permit the formation of cylindrical primary flame, more positively, even by use of a small number of primary fuel nozzles.

(iii) The provision of the baffle plate adjacent the primary fuel nozzle injection holes at the upstream side is effective in holding stable the primary flames emitting from those injection holes.

(iv) The coaxial disposition of plural secondary fuel nozzles relative to the central axis of burner throat will cause a uniform injection of the secondary fuel toward the primary flame and therefore will make the NOx reduction more efficient.

While having described the present invention thus far, it should be understood that tile invention is not limited to the illustrated embodiments and any other modifications, replacements and additions may be applied thereto without departing from tile scope and spirit of tile appended claims therefor.

What is claimed is:

1. A burner device for a low-NOx combustion in a two-stage manner for a furnace, said burner device comprising:

burner throat means for creating a flame and having an inner wall with a central axis and an exit end facing into an inside of the furnace;

means for injecting a body of combustion air in a downstream direction into said burner throat means and through said exit end, into the furnace, said burner throat being substantially unobstructed to provide a linear flow of air therethrough;

first fuel injection means for injecting a primary fuel into burner throat means and around a periphery of said body of combustion air, said first fuel injection means being structured and positioned on the inner wall of said burner throat means and at a location spaced upstream from said exit end by a distance which is selected to create a primary flame in said burner throat means which is confined to the periphery of the body of combustion air and which expands from said exit end into the furnace, said first fuel injection means being further structured and positioned in said burner throat means so that said primary fuel flows in contact only with the periphery of the body of combustion air to mix only with an outer layer of the combustion air for subjecting said primary fuel to a first combustion in such a way that the primary flame is formed into a shape conforming to said inner wall of said of said burner throat means, and circumscribing the body of combustion air in a downstream direction toward the inside of the furnace to leave an unmixed portion of said body of combustion air which penetrates downstream through said primary flame into the furnace, NOx being generated in said primary flame, said first fuel injection means further having an injection axis oriented substantially along the central axis of said burner throat means; and secondary fuel injection means structured and positioned for injecting a secondary fuel around an outer periphery of the primary flame, said secondary fuel injection means being at a location adjacent said exit end of said burner throat means and spaced from the location of said first fuel injection means so that said secondary fuel flows in contact with the primary flame to positively deoxidize the NOx which was generated in said primary flame, and said secondary fuel injection means being further structured and positioned for thereafter subjecting said secondary fuel to a second complete combustion with the unmixed portion of said body of combustion air which penetrated downstream through said primary flame into the furnace, thereby creating a secondary flame in the furnace at a second stage of combustion;

said first and secondary fuel injection means being further structured so that at said first combustion, said body of combustion air is initially covered by said primary flame upstream a location where said secondary fuel is injected, so that said secondary fuel, immediately after being injected toward said combustion air, is intercepted by said primary flame and shielded from said unmixed portion of said body of combustion air and then, at the second stage of combustion, through operation and structure of said second fuel injection means, said secondary fuel is firstly contacted with said primary flame covering said combustion air, to thereby positively deoxidize NOx generated in said primary flame, while said injected secondary fuel is further contacted with the unmixed portion of said combustion air penetrating through said primary flame so as to create said secondary flame.

2. The burner device as defined in claim 1, wherein the burner throat means includes a burner tile facing toward an inside of the furnace, said second fuel injecting means being disposed at a front wall of said burner tile.

3. The burner device as defined in claim 1, wherein said second fuel injection means as disposed at a location adjacent said exit end and on the inner wall of said burner throat.

4. The burner device as defined in claim 1, wherein said burner throat means comprises a burner tile throat and an inner throat member disposed upstream from said burner tile throat, said inner throat member extending toward an entrance of said burner throat means in alignment with an inner wall of said burner tile throat, said first injection means being positioned between said burner tile throat and said inner throat member, and said second injection means being positioned in a front wall of said burner tile throat which faces toward an inside of the furnace and oriented toward the central axis of said burner throat means.

5. The burner device as defined in claim 1, wherein said burner throat means comprises a burner tile throat and an inner throat member disposed upstream from said burner tile throat, said inner throat member extending toward an entrance of said burner throat means in alignment with an inner wall of said burner tile throat, said first injection means being provided between said burner tile throat and said inner throat member, said second injection means being positioned in said inner wall of said burner tile throat at a location adjacent said exit end.

6. The burner device as defined in claim 1, wherein said first injection means comprises at least two primary fuel nozzles for injecting said primary fuel, said at least two nozzles being provided at the inner surface of said burner throat means, and said secondary fuel injection means comprises at least two secondary fuel nozzles for injecting said secondary fuel, said at least two secondary fuel nozzles being provided adjacent the exist end of said burner throat means.

7. The burner device as defined in claim 1, wherein said injection axis of said first fuel injection means is oriented at an angle in the down stream direction toward said exist end.

8. The burner device as defined in claim 1, wherein said injection axis of said first fuel injection means is oriented in a direction tangential to an inner surface of said burner throat means.

9. The burner device as defined in claim 1, wherein said burner throat means is of a generally cylindrical shape, and wherein said first injection means comprises a plurality of nozzles disposed along said generally cylindrical shape of said burner throat means.

10. The burner device as defined in claim 1, wherein said burner throat means is of a rectangular cylindrical shape, and wherein said first injection means comprises a plurality of nozzles disposed along said rectangular cylindrical shape of said burner throat means.

11. The burner device as defined in claim 1, wherein said first fuel injection means includes a plurality of injection holes for the primary fuel and a baffle plate adjacent the injection holes.

12. The burner device as defined in claim 1, further including air velocity adjustment means provided within said burner throat means, said air velocity adjust means being for adjusting a velocity distribution of said combustion air injected through said burner throat means.

13. The burner device as defined in claim 12, wherein said air velocity adjustment means is disposed coaxially relative to the central axis of said burner throat means.

* * * * *